US012678703B2

(12) United States Patent
Jun et al.

(10) Patent No.: US 12,678,703 B2
(45) Date of Patent: Jul. 14, 2026

(54) BLOCK-TYPE ART KIT

(71) Applicants: Hyochan Jun, Jeju-si (KR); Jonghyun Jun, Auckland (NZ)

(72) Inventors: Hyochan Jun, Jeju-si (KR); Jonghyun Jun, Auckland (NZ)

( * ) Notice: Subject to any disclaimer, the term of this patent is extended or adjusted under 35 U.S.C. 154(b) by 271 days.

(21) Appl. No.: 18/297,363

(22) Filed: Apr. 7, 2023

(65) Prior Publication Data

US 2023/0330555 A1 Oct. 19, 2023

(30) Foreign Application Priority Data

Apr. 15, 2022 (KR) ..... 10-2022-0046640
Jan. 11, 2023 (KR) ..... 10-2023-0003791

(51) Int. Cl.
*A63H 33/08* (2006.01)

(52) U.S. Cl.
CPC ..... *A63H 33/086* (2013.01)

(58) Field of Classification Search
CPC ..... A63H 33/08; A63H 33/105; A63H 33/086
USPC ..... 273/156, 157 R
See application file for complete search history.

(56) References Cited

U.S. PATENT DOCUMENTS 176,144 A * 4/1876 McDougall ..... A63F 9/0098 273/272
1,028,058 A * 5/1912 Von Nordenkampp ..... E04F 13/0733 428/49
1,257,655 A * 2/1918 Walden ..... G09B 19/02 434/207
1,573,358 A * 2/1926 Ross ..... A63F 9/06 273/157 R
1,578,225 A * 3/1926 White ..... G09B 1/40 434/238
1,893,944 A * 1/1933 Johnson ..... B44F 3/00 434/96

(Continued)

FOREIGN PATENT DOCUMENTS

CN 203899150 U 10/2014
CN 205918033 U 2/2017

(Continued)

OTHER PUBLICATIONS

Chin, DE20214105521 U1 machine translation, uploaded Feb. 27, 25, Espacenet, 6 pages.*

(Continued)

*Primary Examiner* — Michael D Dennis
*Assistant Examiner* — Matthew B Stanczak
(74) *Attorney, Agent, or Firm* — Knobbe, Martens, Olson & Bear, LLP

(57) ABSTRACT

A block-type art kit is proposed. The kit may include a block frame including a plurality of coupling protrusions arranged at regular intervals in row and column directions on an upper surface thereof. The block-type art kit may further include a plurality of color blocks each having a coupling recess provided from a lower surface thereof such that the coupling protrusion is inserted into the coupling recess. The coupling protrusion may have a through hole formed at a center thereof in a direction penetrating the block frame. The block-type art kit can make it possible to have more diverse expressions in pixel art and makes it easy to modify the created image.

13 Claims, 18 Drawing Sheets

(56) References Cited

U.S. PATENT DOCUMENTS 2,296,623 A * 9/1942 Albosta ..... A63F 3/00 273/156
2,377,100 A * 5/1945 Patterson ..... G09B 23/04 273/156
2,534,550 A * 12/1950 Frechtmann ..... A63F 9/06 434/96
2,738,594 A * 3/1956 Swingle ..... A63H 33/04 446/85
2,759,295 A * 8/1956 Keuls ..... G09B 1/10 248/220.31
2,861,388 A * 11/1958 Favaretto ..... A63H 33/086 446/124
2,885,822 A * 5/1959 Onanian ..... A63H 33/101 174/138 D
2,981,009 A * 4/1961 Lindquist ..... G09B 1/36 273/156
3,191,937 A * 6/1965 Kropinski ..... A63F 9/06 446/124
3,195,266 A * 7/1965 Oanian ..... A63H 33/101 52/603
3,274,727 A * 9/1966 Zander ..... A63F 9/06 428/49
3,420,527 A * 1/1969 Morin ..... A63F 9/06 434/96
3,636,230 A * 1/1972 Tacey ..... G09B 23/02 434/211
3,651,597 A * 3/1972 Daenen ..... A63H 33/086 446/124
3,681,870 A * 8/1972 Alpert ..... A63H 33/108 446/122
3,717,948 A * 2/1973 Schnabel ..... A63H 33/088 446/128
3,748,752 A * 7/1973 Quercetti ..... A63F 9/06 434/96
3,862,512 A * 1/1975 Vogel ..... A63H 33/086 446/128
3,873,096 A * 3/1975 Shoptaugh ..... A63F 9/12 446/124
3,987,558 A * 10/1976 Tsukamoto ..... A63H 33/22 283/117
4,164,091 A * 8/1979 Lin ..... A63H 33/108 446/124
4,183,167 A * 1/1980 Jatich ..... A63F 9/06 446/118
4,308,016 A * 12/1981 White ..... G09B 19/00 446/124
4,358,115 A * 11/1982 Haas ..... A63F 9/10 434/211
4,361,979 A * 12/1982 Petersson ..... A63H 33/108 403/292
4,583,742 A * 4/1986 Slinn ..... A63F 9/10 273/284
4,744,780 A 5/1988 Volpe
4,798,292 A * 1/1989 Hauze ..... A61L 2/26 206/439
4,809,980 A * 3/1989 Bertrand ..... A63F 9/10 434/96
4,964,833 A 10/1990 Suzuki
4,986,756 A * 1/1991 Yamaguchi ..... A63F 9/06 434/96
5,003,746 A * 4/1991 Wilston ..... A63H 33/08 52/592.1
5,061,218 A * 10/1991 Garage ..... A63H 33/086 446/128
5,213,505 A * 5/1993 Laipply ..... G09B 19/0023 434/84
5,322,466 A * 6/1994 Bolli ..... A63H 33/12 24/453
5,562,519 A * 10/1996 Loewenton ..... A63H 33/08 446/108
5,661,941 A * 9/1997 Vataker ..... A63H 33/086 446/124
5,704,789 A * 1/1998 Yang ..... G09B 11/00 434/96
5,795,210 A * 8/1998 Kushner ..... A63H 33/086 446/124
6,102,766 A * 8/2000 Leadbetter ..... A63H 33/086 446/124
6,162,108 A * 12/2000 Frederiksen ..... A63H 33/086 446/128
6,736,691 B1 * 5/2004 Bach ..... A63H 33/101 446/116
7,963,771 B2 * 6/2011 Kumagai ..... G09B 23/18 434/303
8,870,185 B2 * 10/2014 Cheng ..... A63F 3/00003 273/281
8,986,012 B1 * 3/2015 McGee ..... G09B 23/02 434/211
9,010,059 B2 * 4/2015 Lin ..... A63H 33/107 52/603
9,517,423 B1 * 12/2016 Kanbar ..... A63H 33/084
9,956,495 B2 * 5/2018 Kamiyama ..... A63F 9/06
10,118,436 B2 * 11/2018 Skinner ..... B44C 1/28
10,272,352 B2 * 4/2019 Chazen ..... A63H 33/14
10,478,740 B2 * 11/2019 Sakai ..... A63H 33/001
10,559,234 B1 * 2/2020 Younse ..... G09F 7/06
10,744,420 B2 * 8/2020 Sakai ..... A63H 33/08
10,758,813 B2 * 9/2020 Sakai ..... A63H 33/06
10,888,797 B2 * 1/2021 De Wilde ..... A63H 17/262
10,898,821 B2 * 1/2021 Poulus ..... A63H 33/086
D923,090 S * 6/2021 Sakai ..... D19/111
11,117,066 B2 * 9/2021 Sakai ..... A63H 33/001
D958,894 S * 7/2022 Xu ..... D21/336
11,577,176 B2 * 2/2023 Ye ..... A63H 33/102
11,964,216 B2 * 4/2024 Feng ..... A63H 33/086
2005/0016047 A1 1/2005 Yamagishi
2006/0276100 A1 * 12/2006 Glickman ..... A63H 33/086 446/120
2010/0029168 A1 * 2/2010 Fleming ..... A63H 33/08 446/124
2010/0210172 A1 * 8/2010 Worthington ..... A63H 33/088 446/124
2010/0289215 A1 * 11/2010 Tan ..... A63F 9/06 273/156
2011/0073519 A1 * 3/2011 Davis, II ..... B65D 1/34 206/562
2011/0124263 A1 * 5/2011 Cheng ..... A63H 33/04 446/118
2012/0186748 A1 * 7/2012 Kamiyama ..... A63H 9/00 156/349
2013/0026337 A1 * 1/2013 Svensson ..... A63H 33/086 249/98
2013/0078034 A1 3/2013 Kapelonis
2013/0183881 A1 * 7/2013 Kamiyama ..... B44C 3/12 446/87
2014/0011422 A1 * 1/2014 Channin ..... A63H 33/08 446/85
2014/0120501 A1 * 5/2014 Cooke ..... B44C 3/123 434/81
2014/0127471 A1 * 5/2014 Matsubara ..... B32B 3/28 428/172
2014/0256211 A1 9/2014 Cheng
2016/0051903 A1 2/2016 Nilsson
2016/0271510 A1 * 9/2016 Ho ..... A63H 33/14
2016/0354705 A1 * 12/2016 Poulus ..... A63H 33/04
2017/0036136 A1 * 2/2017 Chazen ..... A63H 33/086
2017/0087480 A1 * 3/2017 Poulus ..... A63H 33/086
2018/0043276 A1 * 2/2018 Sakai ..... A63H 33/14
2019/0184276 A1 6/2019 Chazen
2019/0192987 A1 * 6/2019 Wakim ..... A63H 33/08
2019/0255429 A1 * 8/2019 Chazen ..... A63F 9/1044
2020/0054957 A1 2/2020 Chan et al.
2021/0038972 A1 * 2/2021 Lin ..... A63F 9/1208
2023/0211251 A1 * 7/2023 Robbins ..... A63H 33/14 446/124
2023/0330555 A1 * 10/2023 Jun ..... A63H 33/086
2024/0024795 A1 * 1/2024 Li ..... A63H 33/001
2024/0238690 A1 * 7/2024 Sakai ..... A63H 33/14

(56) References Cited

U.S. PATENT DOCUMENTS

| | | | | |
|---|---|---|---|---|
| 2024/0335762 | A1* | 10/2024 | Smith | A63H 33/086 |
| 2024/0367068 | A1* | 11/2024 | Sakai | A63H 33/001 |
| 2024/0408507 | A1* | 12/2024 | Thijs | A63H 33/065 |

FOREIGN PATENT DOCUMENTS

| | | | | |
|---|---|---|---|---|
| CN | 206745992 | U | 12/2017 | |
| CN | 107614078 | A | 1/2018 | |
| CN | 207286689 | U | 5/2018 | |
| CN | 208115173 | U | 11/2018 | |
| CN | 210674227 | U | 6/2020 | |
| CN | 211097529 | U | 7/2020 | |
| DE | 202014105521 | U1 * | 2/2015 | F16B 7/04 |
| EP | 1690575 | A1 | 8/2006 | |
| EP | 3549650 | A1 | 10/2019 | |
| EP | 3608005 | A1 | 2/2020 | |
| FR | 2083274 | A5 | 12/1971 | |
| GB | 890608 | A | 3/1962 | |
| JP | S49-008345 | A | 1/1974 | |
| JP | S59-161897 | U | 10/1984 | |
| JP | H08-500265 | A | 1/1996 | |
| JP | 2002-315974 | A | 10/2002 | |
| JP | 2014-510558 | A | 5/2014 | |
| JP | 2014-204920 | A | 10/2014 | |
| KR | 10-2020-0009198 | A | 1/2020 | |
| KR | 20-2021-0000317 | U | 2/2021 | |
| KR | 10-2246871 | B1 | 4/2021 | |
| WO | WO 94/04240 | A1 | 3/1994 | |
| WO | WO 03/103793 | A1 | 12/2003 | |
| WO | 2004/067128 | A2 | 12/2004 | |
| WO | WO 2015/141962 | A1 | 9/2015 | |

OTHER PUBLICATIONS

European Search Report dated Aug. 9, 2023 in European Application No. 23167502.6.

Office Action dated Oct. 23, 2023 in Australian Application No. 2023202219.

"The new LEGO® 1×2 Rounded Plate | New Elementary: LEGO® Parts, Sets and Techniques," Jan. 14, 2018. Retrieved from https://www.newelementary.com/2018/01/the-new-lego-1×2-rounded-plate.html on Nov. 17, 2023.

Office Action in Japanese Application No. 2023-066647 dated Dec. 12, 2023.

Office Action dated May 22, 2023 in Korean Application No. 10-2023-0003791.

Office Action dated May 22, 2023 in Korean Application No. 10-2023-0003791 and its English translation. (This KR Office Action was submitted on Aug. 21, 2023, and now being resubmitted along with its English translation.).

Chinese Office Action in Chinese Patent Application No. 202310389120.4, dated Aug. 23, 2024, in 17 pages.

* cited by examiner (a)

(b)

(a)

(b)

(a)

(b)

(a)

(b)

(a)

(b)

BLOCK-TYPE ART KIT

CROSS REFERENCE TO RELATED APPLICATIONS

The present application claims priority to Korean Patent Application No. 10-2022-0046640 filed Apr. 15, 2022, and Korean Patent Application No. 10-2023-0003791 filed Jan. 11, 2023, the entire contents of each of which are incorporated herein for all purposes by this reference.

BACKGROUND

Technical Field

The present disclosure relates to a block-type art kit that is easy to assemble and disassemble and capable of various expressions.

Description of Related Technology

Pixel art is one of the arts for children's play, development, or hobbies. The pixel art is a technique to express a desired image by preparing mediums serving as pixels in various colors and arranging the mediums of various colors at desired positions. The mediums serving as pixels include, for example, threads, blocks, beads, and the like.

SUMMARY

One aspect is a block-type pixel art kit capable of more diverse expressions and easy modification of image.

Another aspect is a block-type art kit that may include a block frame including a plurality of coupling protrusions arranged at regular intervals in row and column directions on an upper surface thereof, and a plurality of color blocks each having a coupling recess provided from a lower surface thereof such that the coupling protrusion is inserted into the coupling recess. The coupling protrusion may have a through hole formed at a center thereof in a direction penetrating the block frame.

In addition, the coupling protrusion may have a rectangular shape on a horizontal cross-section and have an auxiliary coupling groove on each of four side surfaces.

The block-type art kit may further include a plurality of quarter color blocks each formed to have a horizontal cross-section of a quarter of the size of the color block, each quarter color block having a second coupling recess at one lower corner portion thereof such that one corner portion of the coupling protrusion is inserted into the second coupling recess.

In addition, a block detachable hole may be formed at a bottom of a side of the color block.

The block-type art kit may further include an adapter block for connecting the coupling protrusion and the color block.

In addition, the adapter block may have a horizontal cross-section of the same shape as that of the coupling protrusion and have a fixing protrusion formed on a lower surface thereof to be inserted into the through hole of the coupling protrusion.

The block-type art kit may further include an auxiliary adapter block having a smaller height than the coupling protrusion, and having at a center thereof a coupling hole having a shape engaged with the coupling protrusion.

The block-type art kit may further include a second adapter block for connecting the coupling protrusion and the adapter block.

In addition, the second adapter block may be formed to surround the coupling protrusion at a lower portion thereof and have at an upper portion thereof the same horizontal cross-section as that of the coupling protrusion. Also, the second adapter block may have at a center thereof a second through hole vertically penetrating the second adapter block.

The block-type art kit may further include a plurality of frame coupling protrusions formed on a lower surface of the block frame and arranged to be spaced apart in the row and column directions.

The block-type art kit may further include a bent connection member composed of a first plate portion and a second plate portion connected to each other at a right angle, each of the first plate portion and the second plate portion having a frame coupling hole into which the frame coupling protrusion is inserted.

The block-type art kit may further include a flat connection member having a plate shape and having a plurality of second frame coupling holes into which the frame coupling protrusions are inserted.

The block-type art kit may further include a corner member having one third frame coupling hole into which the frame coupling protrusion is inserted.

According to the block-type art kit of the present disclosure, it is easy to remove the color block coupled to the block frame, so that an image created by the block-type art kit can be easily changed.

Also, in addition to the color block, the quarter color block having a size of a quarter of the color block can be combined with the block frame, so that an image created by the block-type art kit can be expressed in more detail.

In addition, it is possible to express an image created by the block-type art kit in a three dimension using the adapter block and the second adapter block, so that the image can be expressed in more diverse ways.

DETAILED DESCRIPTION

Figure 1:
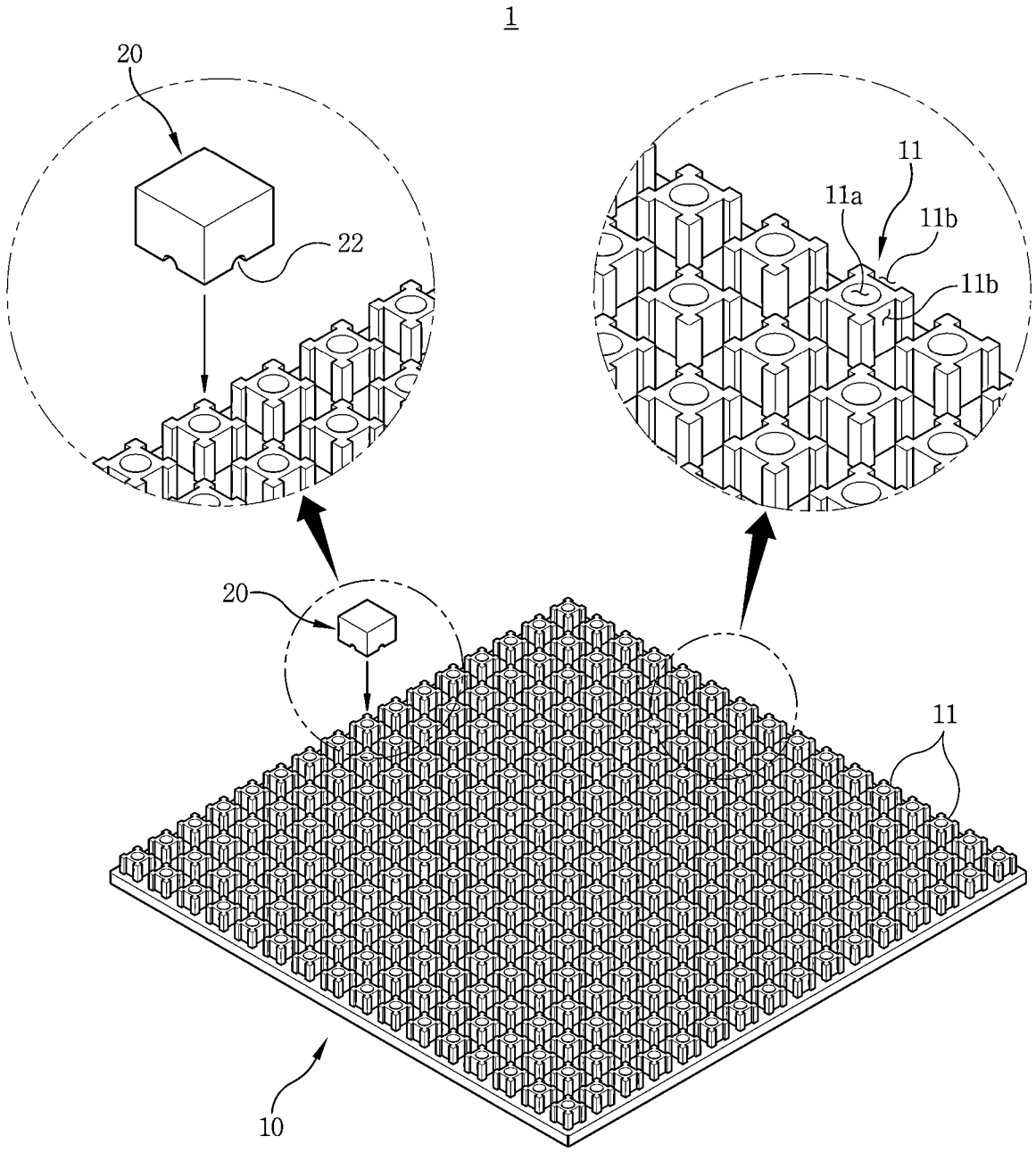
FIG. 1 is a perspective view illustrating a block-type art kit according to the present disclosure.

The pixel art has the advantage of being accessible and enjoyable to anyone because it can easily express a variety of images by arranging the mediums that act as pixels.

However, since the pixel mediums have a uniform shape, there are bound to be restrictions on expression. In addition, when the size of the pixel medium (particularly, a block) is reduced to enable more detailed expression, there is a problem in that it is not easy to change the position of the pixel medium once it is fixed.

Hereinafter, various embodiments of the present disclosure will be described in detail with reference to the accompanying drawings. The present disclosure may, however, be embodied in many different forms and should not be construed as being limited to the embodiments set forth herein. Rather, these embodiments are provided so that the invention will be thorough and complete and will fully convey the scope of the invention to those skilled in the art.

In the following description of embodiments, techniques that are well known in the art and not directly related to the present disclosure are not described. This is to clearly convey the subject matter of the present disclosure by omitting an unnecessary explanation. For the same reason, some elements in the drawings are exaggerated, omitted, or schematically illustrated. Also, the size of each element does not entirely reflect the actual size. In the disclosure, the same or corresponding elements are denoted by the same reference numerals.

Figure 2:
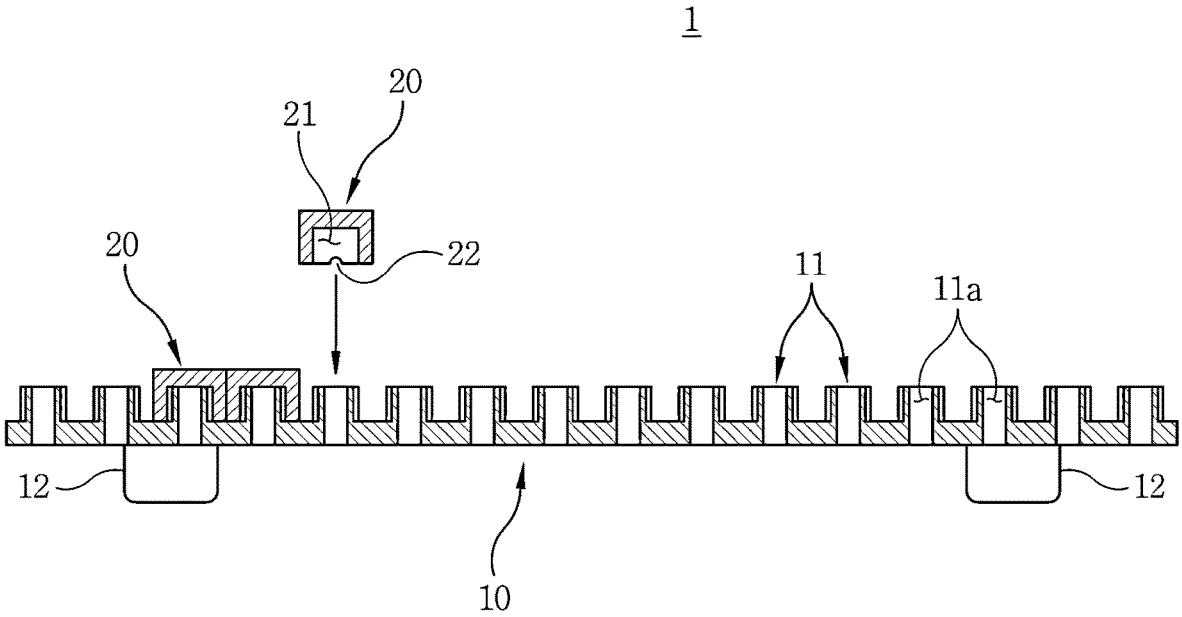
FIG. 2 is a cross-sectional view illustrating a block-type art kit according to the present disclosure.

FIG. 1 is a perspective view illustrating a block-type art kit 1 according to the present disclosure, and FIG. 2 is a cross-sectional view illustrating a block-type art kit 1 according to the present disclosure.

The block-type art kit 1 according to the present disclosure basically includes a block frame 10 and a plurality of color blocks 20.

The color blocks 20 used in the block-type art kit 1 have various colors. Arranging the color blocks 20 of different colors at desired positions on the block frame 10, respectively, it is possible to create a desired image. At least two of the plurality of color blocks have different colors. Each of the color blocks 20 includes a solid and continuous upper surface that is at least partially aligned with the through holes of the coupling protrusions 11 (See FIG. 1). Each of the thorough holes may enable a selected one of the plurality of color blocks to be detached from a corresponding coupling protrusion.

The block frame 10 has a plate shape as a whole. Although FIG. 1 shows the block frame 10 formed of a rectangular plate shape, it is also possible to form a circular, hexagonal, or any other shape. A plurality of coupling protrusions 11 are provided on the upper surface of the block frame 10. The coupling protrusions 11 are arranged at regular intervals in the row and column directions, and may be formed on the entire surface of the block frame 10. The coupling protrusion 11 serves to fix the color block 20 to the block frame 10.

The color block 20 has a hexahedral shape as a whole. A horizontal cross-sectional size of the collar block 20 corresponds to the size of a space occupied by one coupling protrusion 11 on the block frame 10. A coupling recess 21 is provided from the lower surface of the color block 20 so that the coupling protrusion 11 of the block frame 10 can be inserted. The color block 20 can be fixed to the block frame 10 when the coupling recess 21 of the color block 20 is fitted with the coupling protrusion 11 of the block frame 10.

Each coupling protrusion 11 has a through hole 11*a* formed at the center thereof in a direction penetrating the block frame 10, that is, in a vertical direction.

If the distance between the adjacent coupling protrusions 11 or the size of each color block 20 is reduced in order to make an image created by the block-type art kit 1 more detailed, it may be difficult to change the position of the color block 20 after fitted with the coupling protrusion 11 of the block frame 10. In particular, it is not easy to remove the color block 20 surrounded by neighboring color blocks 20 from the block frame 10.

The through hole 11*a* makes it possible to easily remove the color block 20 fixed to the block frame 10 so that the position of the color block 20 can be easily changed. That is, the color block 20 can be easily removed from the block frame 10 when a pointed object such as an awl or a pin is inserted into the through hole 11*a* from the bottom of the block frame 10 to push the color block 20 out.

The color block 20 may have various sizes. That is, one color block 20 may be formed to have various numbers of coupling recesses 21. In this case, such respective coupling recesses 21 of one color block 20 are formed at the same interval as the coupling protrusions 11 of the block frame 10 to be fitted with the block frame 10.

The coupling protrusion 11 may have a rectangular shape on a horizontal cross-section and may have an auxiliary coupling groove 11*b* on each of four side surfaces. The auxiliary coupling groove 11*b* is formed in a long rectangular shape on the horizontal cross-section of the coupling protrusion 11 and is extended over the entire height direction (vertical direction) of the coupling protrusion 11.

Figure 3A:
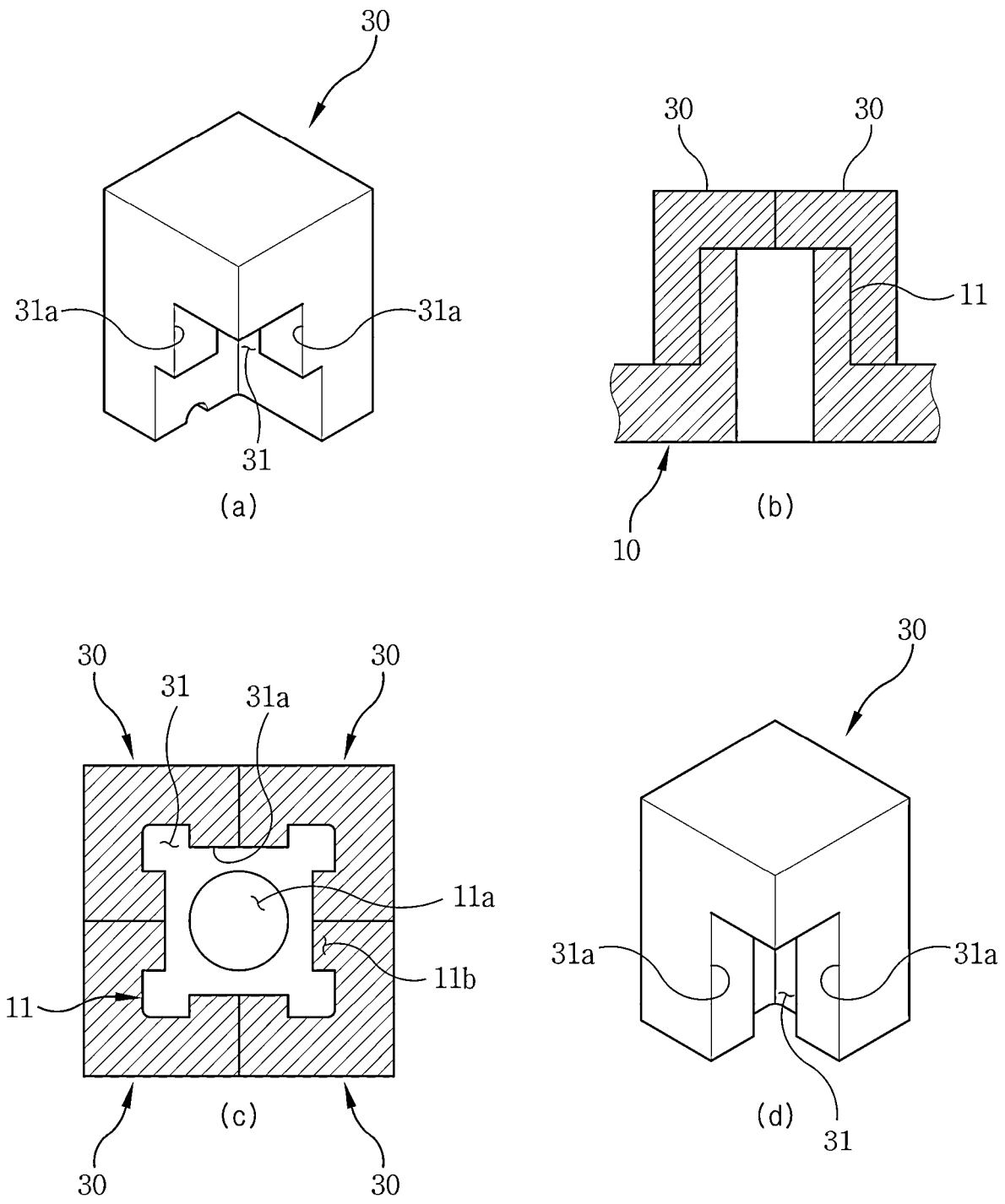
FIG. 3A shows various views illustrating a quarter color block used in a block-type art kit according to the present disclosure.

In the case that the coupling protrusion 11 has the auxiliary coupling groove 11*b*, the block-type art kit 1 according to the present disclosure may further include a plurality of quarter color blocks 30. FIG. 3A shows perspective views and cross-sectional views illustrating a quarter color block 30 used in a block-type art kit according to the present disclosure (see (a), (b), (c), and (d) of FIG. 3A).

The quarter color block 30 is formed of a hexahedral shape having a horizontal cross-section of a quarter of the size of the color block 20. In addition, the height of the quarter color block 30 is the same as the height of the color block 20. Thus, when four quarter color blocks 30 are arranged, they occupy substantially the same area as the area occupied by one color block 20.

The quarter color block 30 has a second coupling recess 31 at one lower corner portion thereof. One corner portion of the coupling protrusion 11 can be inserted into the second coupling recess 31. That is, four quarter color blocks 30 can be fitted with four corner portions of the coupling protrusion 11 to fill the space occupied by one color block 20.

The quarter color block 30 makes it possible to more precisely express an image created using the block-type art kit 1 of the present disclosure.

The second coupling recess 31 has a rectangular shape on a horizontal cross-section. In addition, the second coupling recess 31 has an auxiliary coupling protrusion 31*a* formed on the inner surface thereof to face and be engaged with the auxiliary coupling groove 11*b* of the coupling protrusion 11. The quarter color block 30 having the second coupling recess 31 is coupled to the coupling protrusion 11 as if gripping the corner portion of the coupling protrusion 11, it can be firmly fixed to the coupling protrusion 11. The auxiliary coupling protrusion 31*a* may be formed only at an upper portion of the second coupling recess 31 in the height direction as shown in (a) of FIG. 3A, or may be extended over the entire height direction of the second coupling recess 31 as shown in (d) of FIG. 3A.

Figure 3B:
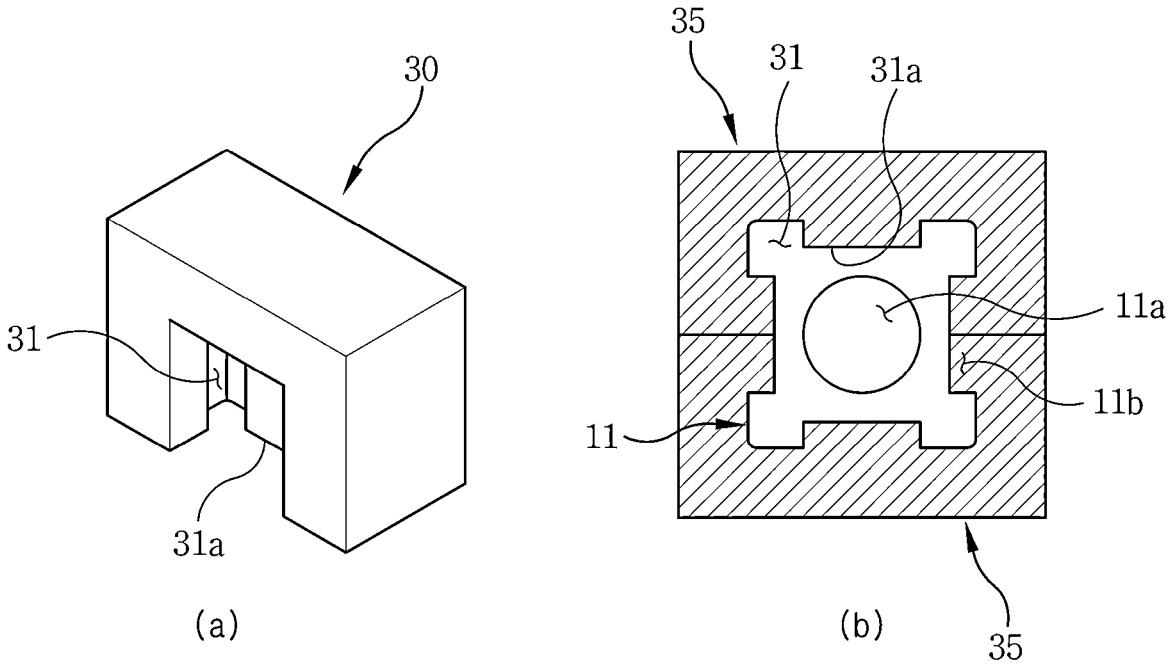
FIG. 3B shows various views illustrating a half color block used in a block-type art kit according to the present disclosure.

As shown in (a) and (b) of FIG. 3B, the block-type art kit 1 according to the present disclosure may further include a half color block 35 formed to be half the size of the color block 20. Like the quarter color block 30 discussed above, the half color block 35 may have the second coupling recess 31 and the auxiliary coupling protrusion 31*a*.

Meanwhile, a block detachable hole 22 may be formed at the bottom of the side of the color block 20.

By inserting a pointed object such as an awl or a pin into the block detachable hole 22 and lifting the color block 20, the color block 20 fixed to the block frame 10 can be easily removed from the block frame 10.

The block detachable hole 22 may be formed on only some or all of the four sides of the collar block 20.

In addition, the block detachable hole 22 can be formed at the bottom of the side of the quarter color block 30 or the half color block 35.

Figure 4:
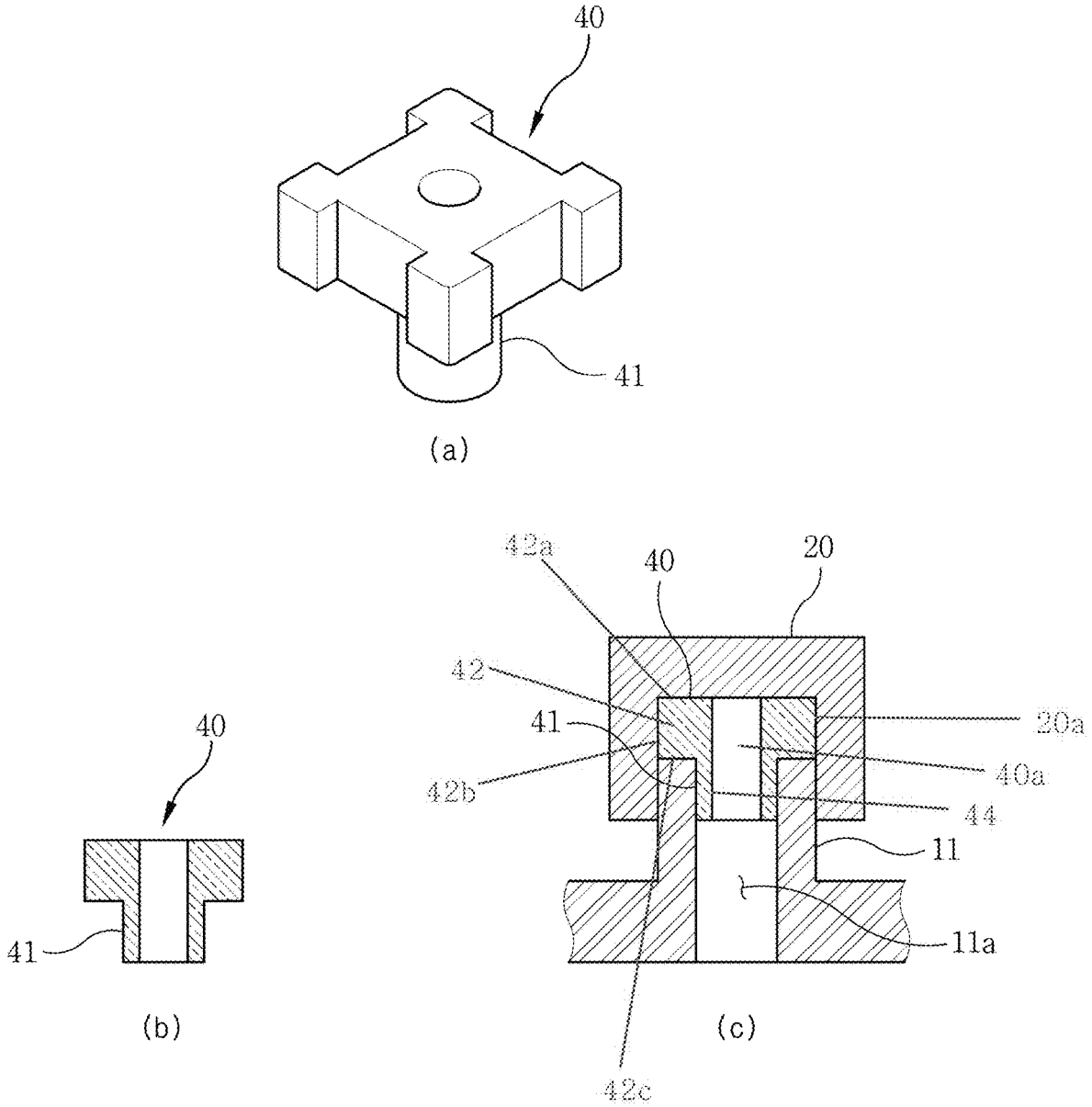
FIG. 4 shows various views illustrating an adapter block used in a block-type art kit according to the present disclosure.

The block-type art kit 1 according to the present disclosure may further include an adapter block 40. FIG. 4 shows various views illustrating an adapter block 40 used in a block-type art kit according to the present disclosure (see (a), (b), and (c) of FIG. 4).

The adapter block 40 serves to connect the coupling protrusion 11 of the block frame 10 and the color block 20. That is, after the adapter block 40 is fitted with the coupling protrusion 11 of the block frame 10, the color block 20 can be fitted with the adapter block 40.

In the case of coupling the color block 20 to the block frame 10 by using the adapter block 40, the color block 20 will further protrude from the block frame 10 compared to the case of directly coupling the color block 20 to the block frame 10. It is therefore possible to form an image three-dimensionally and diversify image expression through the block-type art kit 1 of the present disclosure.

Specifically, the adapter block 40 has a horizontal cross-section of the same shape as that of the coupling protrusion 11 and has a fixing protrusion 41 formed on a lower surface thereof. The fixing protrusion 41 can be inserted into the through hole 11*a* of the coupling protrusion 11 to be engaged with the coupling protrusion 11. The adapter block 40 can be fixed to the block frame 10 when the fixing protrusion 41 is inserted into the through hole 11*a* of the coupling protrusion 11, and the color block 20 can be fixed to the adapter block 40 when the coupling recess 21 of the color block 20 is fitted with the adapter block 40. Referring to (c) of FIG. 4, the adapter block 40 includes an upper portion 42 and a lower portion 44 narrower than the upper portion 42. Each coupling protrusion 11 has a through hole 11*a* formed at a center thereof in a direction penetrating therethrough and penetrating through a portion of the substrate from which the corresponding coupling protrusion extends. The adapter block 40 includes a second through hole 40*a* penetrating therethrough. When the adapter block 40 is connected to the coupling protrusion 11 and the color block 20, 1) a side surface 42*b* of the upper portion 42 of the adapter block 40 is, or 2) both the side surface 42*b* and the top surface 42*a* of the upper portion 42 of the adapter block 40 are, in direct physical contact with an inner portion 20*a* of a corresponding color block 20. When the adapter block 40 is connected to the coupling protrusion 11 and the color block 20, a bottom surface 42*c* of the upper portion 42 of the adapter block 40 is in direct physical contact with the corresponding coupling protrusion 11, and the lower portion 44 of the adapter block 40 is in direct physical contact with and is surrounded by the corresponding coupling protrusion 11. As described above (see paras. [0055] and [0056]) and as shown in FIG. 2, a block detachable hole 22 may be formed at the bottom of the side of the color block 20, and by inserting a pointed object such as an awl or a pin into the block detachable hole 22 and lifting the color block 20, the color block 20 fixed to the block frame 10 can be easily removed from the block frame 10. As shown in (c) of FIG. 4, when the adapter block 40 is connected to the coupling protrusion 11 and the color block 20, the second through hole 40*a* of the adapter block 40 is aligned with the through hole 11*a* of the corresponding coupling protrusion 11. Thus, when the adapter block 40 is connected to the coupling protrusion 11 and the color block 20, the second through hole 40*a* of the adapter block 40 and the through hole 11*a* of the corresponding coupling protrusion 11 may together enable the corresponding color block 20 to be detached from the corresponding coupling protrusion 11 by a pointed object inserted through both of the through hole 11*a* and the second through hole 44*a* from the bottom of the substrate of the block frame.

Figure 5:
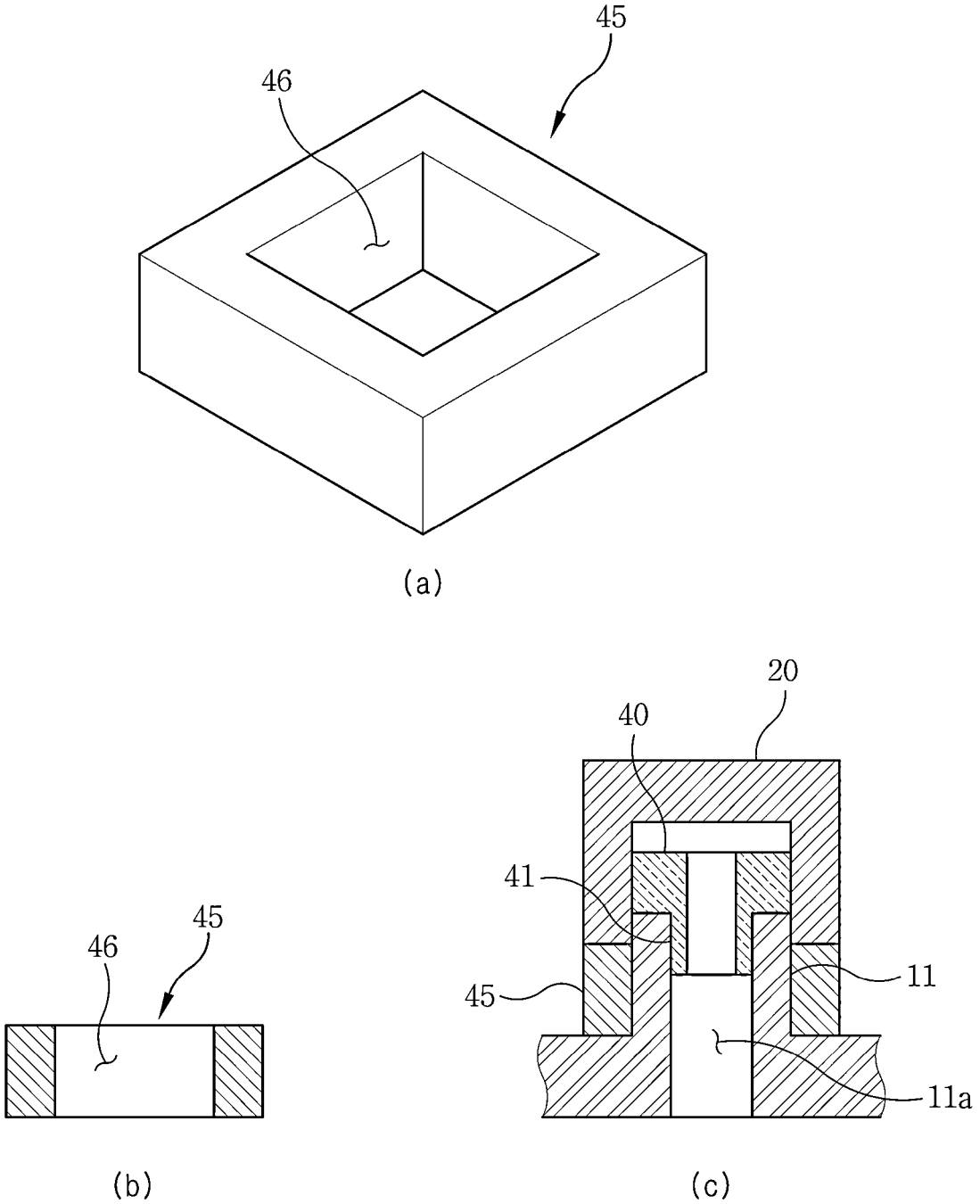
FIG. 5 shows various views illustrating an auxiliary adapter block used in a block-type art kit according to the present disclosure.

The block-type art kit 1 according to the present disclosure may further include an auxiliary adapter block 45. FIG. 5 shows various views illustrating an auxiliary adapter block 45 used in a block-type art kit according to the present disclosure (see (a), (b), and (c) of FIG. 5).

The auxiliary adapter block 45 is formed in a thin square tube shape having a smaller height than the coupling protrusion 11 of the block frame 10. The auxiliary adapter block 45 has at the center thereof a coupling hole 46 having a shape engaged with or configured to receive the coupling protrusion 11. The coupling hole 46 is formed to vertically penetrate the auxiliary adapter block 45. As shown in (b) and (c) of FIG. 5, and (d) of FIG. 6, when the adapter block 40 is connected to the coupling protrusion 11 and the color block 20, the auxiliary adapter block 45 may have a smaller height than the coupling protrusion 11, and have at a center thereof a coupling hole 46 configured to receive the coupling protrusion 11. As shown in (c) of FIG. 5 and (d) of FIG. 6, the coupling hole 46 is larger in diameter than the through hole 11*a* of the corresponding coupling protrusion 11. Furthermore, when the auxiliary adapter block 45 is assembled between the color block 40 and the coupling protrusion 11, the coupling hole 46 of the auxiliary adapter block 45 is aligned with both of the second through hole 40*a* of the adapter block 40 and the through hole 11*a* of the corresponding coupling protrusion 11.

The auxiliary adapter block 45 serves to adjust the height of the color block 20 in the case where the adapter block 40 is used. That is, as shown in (c) of FIG. 5, after coupling the adapter block 40 and the auxiliary adapter block 45 to the coupling protrusion 11, the color block 20 can be coupled to the adapter block 40. If this is done, the length at which the color block 20 is coupled to the adapter block 40 is reduced due to the height of the auxiliary adapter block 45. Therefore, compared to the case where there is no auxiliary adapter block 45, the color block 20 can be coupled to a higher position from the block frame 10.

Figure 6:
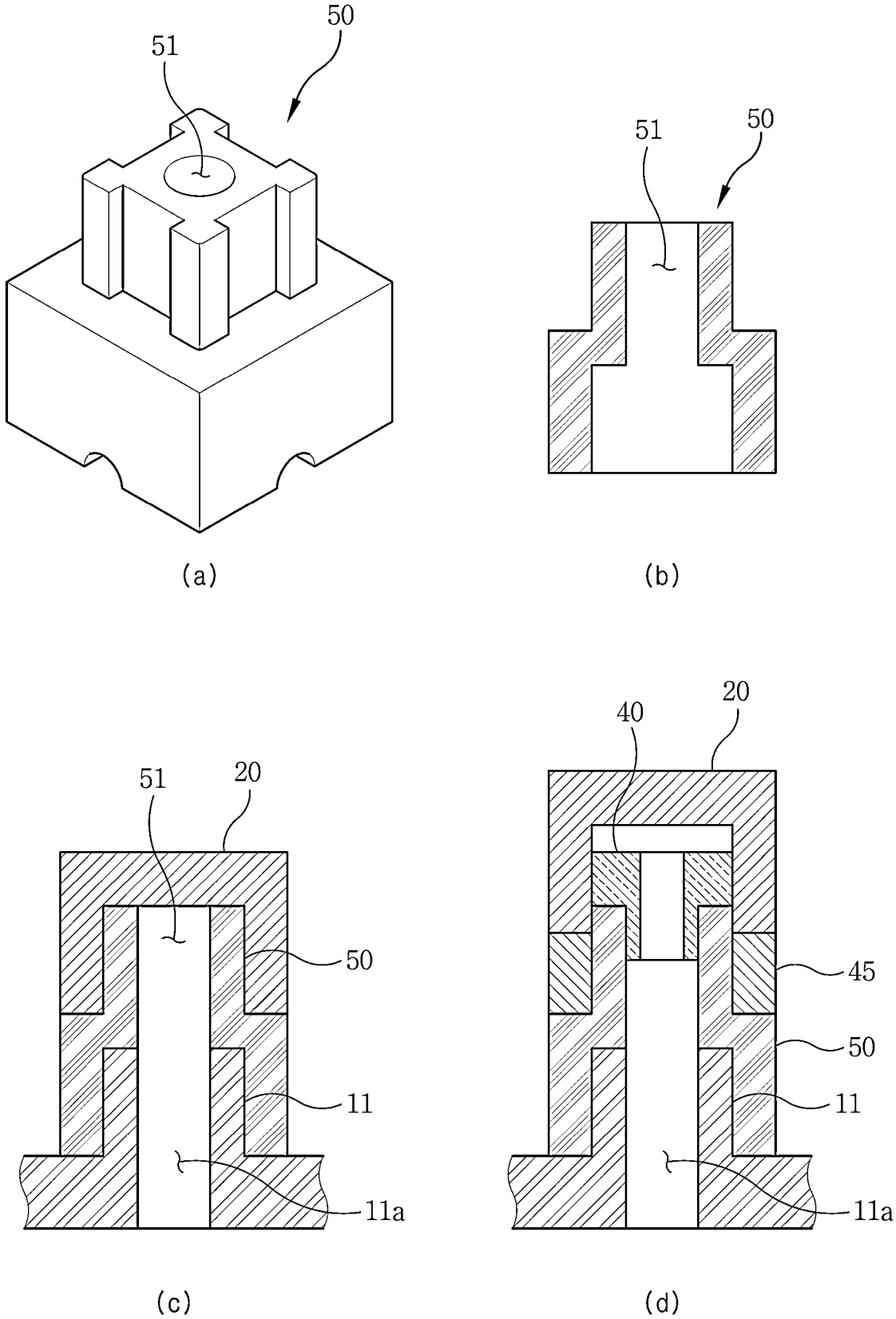
FIG. 6 shows various views illustrating a second adapter block used in a block-type art kit according to the present disclosure.

The block-type art kit 1 according to the present disclosure may further include a second adapter block 50. FIG. 6 shows various views illustrating a second adapter block 50 used in a block-type art kit according to the present disclosure (see (a), (b), (c), and (d) of FIG. 6).

The second adapter block 50 serves to connect the coupling protrusion 11 and the adapter block 40. That is, by sequentially coupling the second adapter block 50, the adapter block 40, and the color block 20 to the coupling protrusion 11 of the block frame 10, the color block 20 can be coupled to the block frame 10 through the second adapter block 50 and the adapter block 40.

The second adapter block 50 allows an image created by the block-type art kit 1 of the present disclosure to be formed more three-dimensionally.

Specifically, the second adapter block 50 is formed to surround the coupling protrusion 11 at a lower portion thereof and have at an upper portion thereof the same horizontal cross-section as that of the coupling protrusion 11. Both the adapter block 40 and the color block 20 can be coupled to the second adapter block 50. In addition, two or more second adapter blocks 50 can be coupled to each other, thereby allowing an image created by the block-type art kit 1 of the present disclosure to be more three-dimensional.

As shown in (d) of FIG. 6, the second adapter block 50 may be used together with the auxiliary adapter block 45. That is, by coupling the auxiliary adapter block 45 to the upper end of the second adapter block 50, it is possible to adjust the coupling length of the color block 20 to the second adapter block 50.

The second adapter block 50 has at the center thereof a second through hole 51 vertically penetrating the second adapter block 50. When a pin or the like passes through the through hole 11*a* of the block frame 10 and the second through hole 51 of the second adapter block 50, the color block 20 or the adapter block 40 can be easily separated from the second adapter block 50.

Like the block detachable hole 22 of the color block 20, a block detachable hole may be formed at the bottom of the side of the second adapter block 50.

Figure 7:
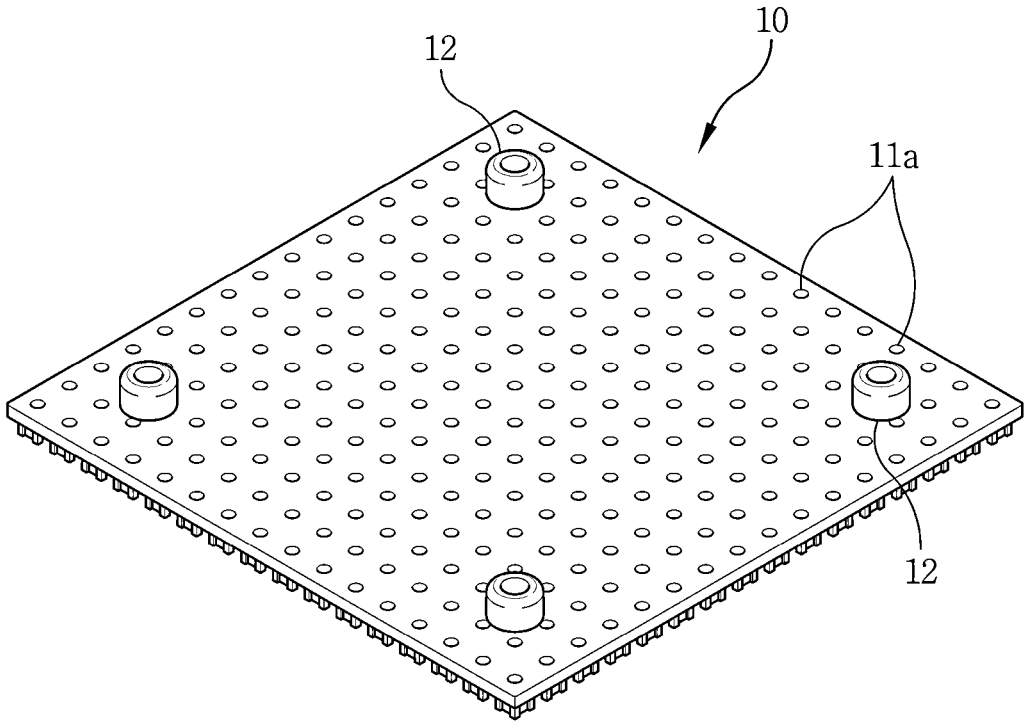
FIG. 7 is a perspective view illustrating a lower surface of a block frame used in a block-type art kit according to the present disclosure.

Meanwhile, a plurality of frame coupling protrusions 12 may be formed on the lower surface of the block frame 10. FIG. 7 is a perspective view illustrating a lower surface of a block frame 10 used in a block-type art kit according to the present disclosure.

The frame coupling protrusions 12 are arranged to be spaced apart in the row and column directions. The frame coupling protrusions 12 may be formed regardless of the location of the coupling protrusion 11. The frame coupling protrusions 12 may be used to connect different coupling frames.

Accordingly, it is possible to variously form the overall size or shape of an image created using the block-type art kit 1 of the present disclosure.

Figure 8A:
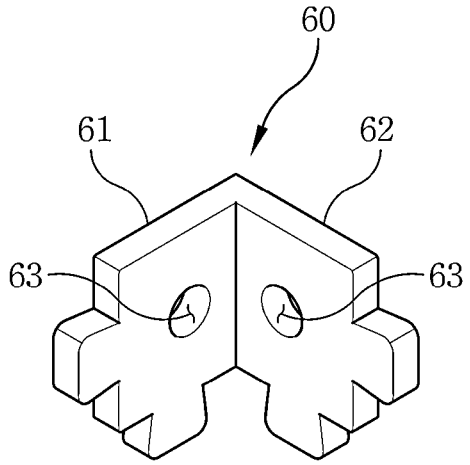
FIGS. 8A to 8C show various views illustrating a bent connection member used in a block-type art kit according to the present disclosure.
Figure 8A:
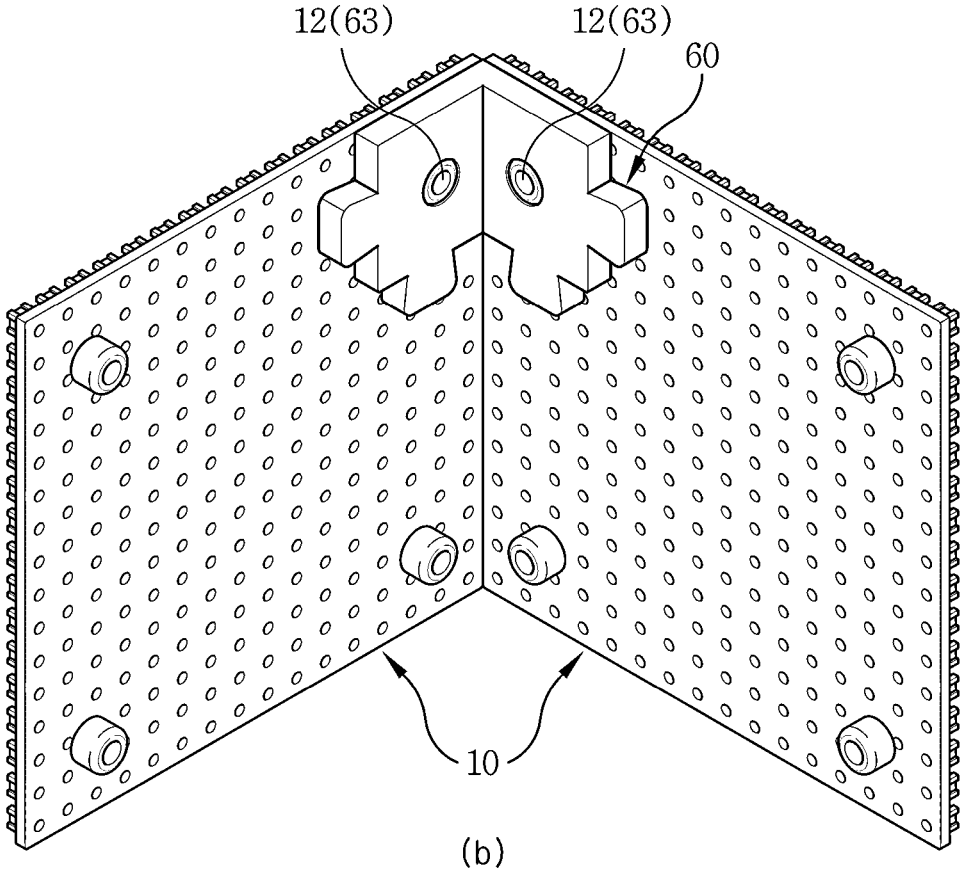

In the case where the block frame 10 includes the frame coupling protrusions 12, the block-type art kit 1 according to the present disclosure may further include a bent connection member 60. FIG. 8A illustrates a bent connection member 60 according to one embodiment of the present disclosure (see (a) and (b) of FIG. 8A).

The bent connection member 60 is composed of a first plate portion 61 and a second plate portion 62 connected to each other at a right angle. Each of the first plate portion 61 and the second plate portion 62 has a frame coupling hole 63 into which the frame coupling protrusion 12 can be inserted.

The bent connection member 60 can connect two block frames 10 at a right angle. That is, one block frame 10 is coupled to the frame coupling hole 63 of the first plate portion 61, and another block frame 10 is coupled to the frame coupling hole 63 of the second plate portion 62, so that the block frames 10 can be connected to each other at a right angle. Also, four block frames 10 can be combined with each other through four bent connection members 60 at right angles to form a box shape. For a firm coupling between adjacent block frames 10, two bent connection members 60 may be used to couple the adjacent block frames 10 at two positions.

Figure 8B:
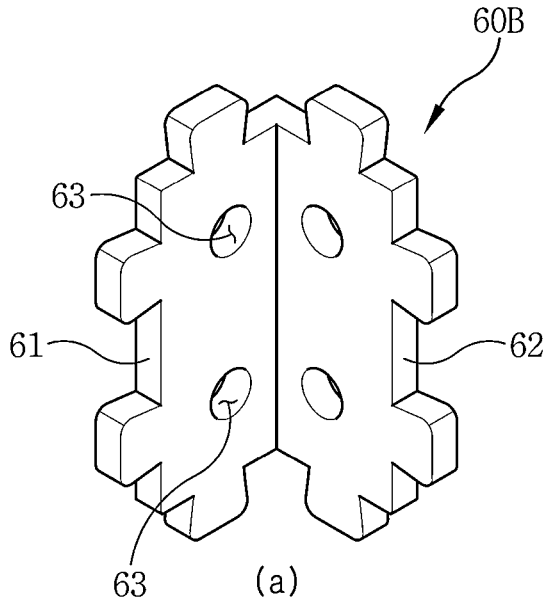
Figure 8B:
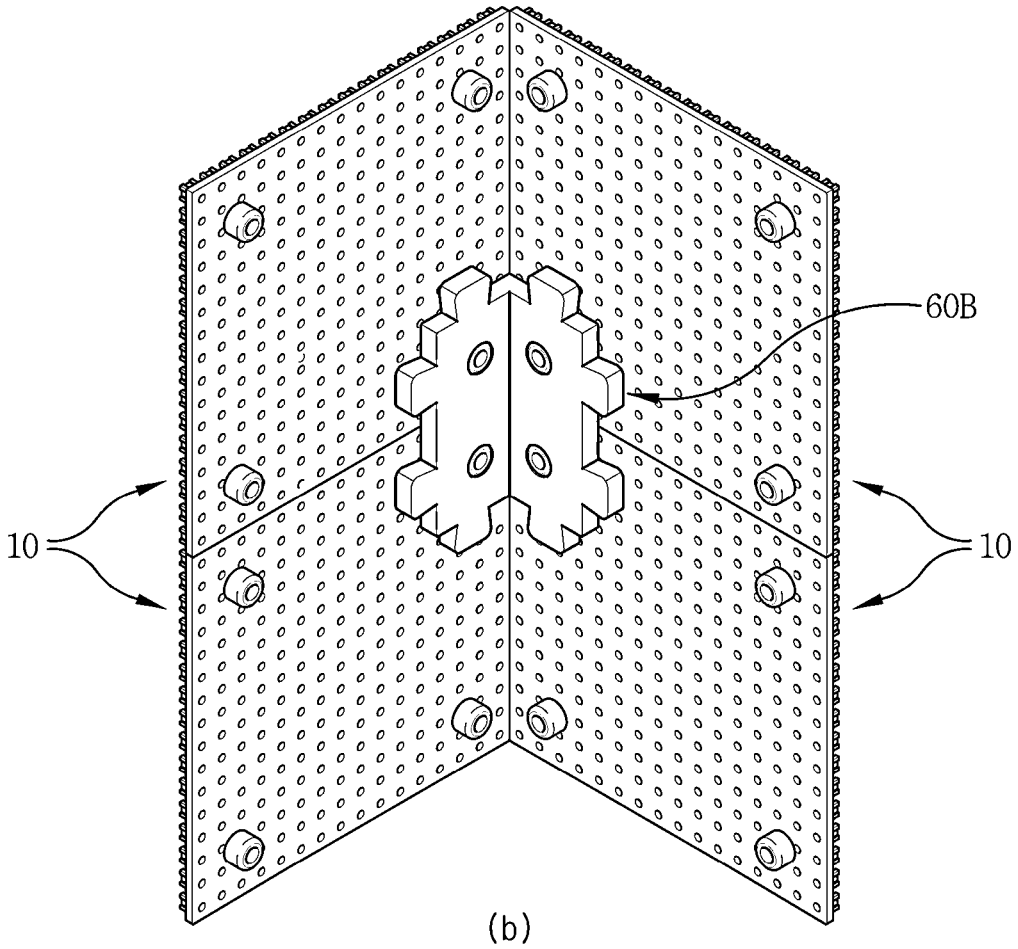

FIG. 8B illustrates a bent connection member 60B according to another embodiment of the present disclosure (see (a) and (b) of FIG. 8B). The bent connection member 60B according to this embodiment not only connects the block frames 10 disposed side by side at a right angle, but also connects the block frames 10 disposed up and down. That is, only one bent connection member 60B can connect four block frames 10. To this end, in the bent connection member 60B according to this embodiment, two frame coupling holes 63 are formed in upper and lower parts of each of the first and second plate portions 61 and 62 connected to each other at a right angle. Two upper and lower block frames 10 can be coupled to the first plate portion 61 of the bent connection member 60B, and other two other upper and lower block frames 10 can be coupled to the second plate portion 62. This bent connection member 60B can be used to form a larger box shape.

Figure 8C:
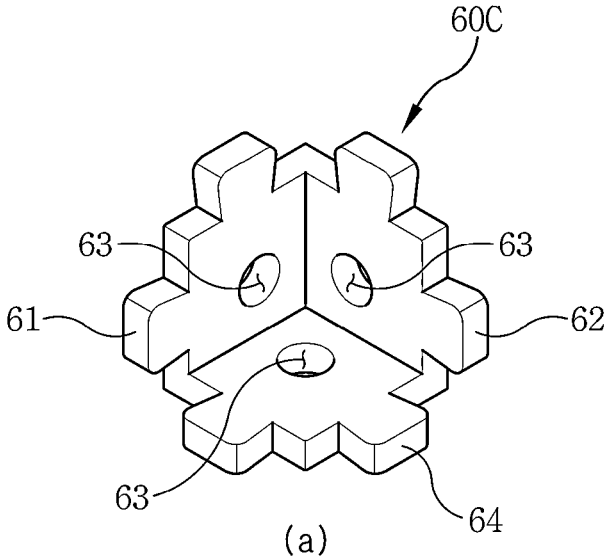
Figure 8C:
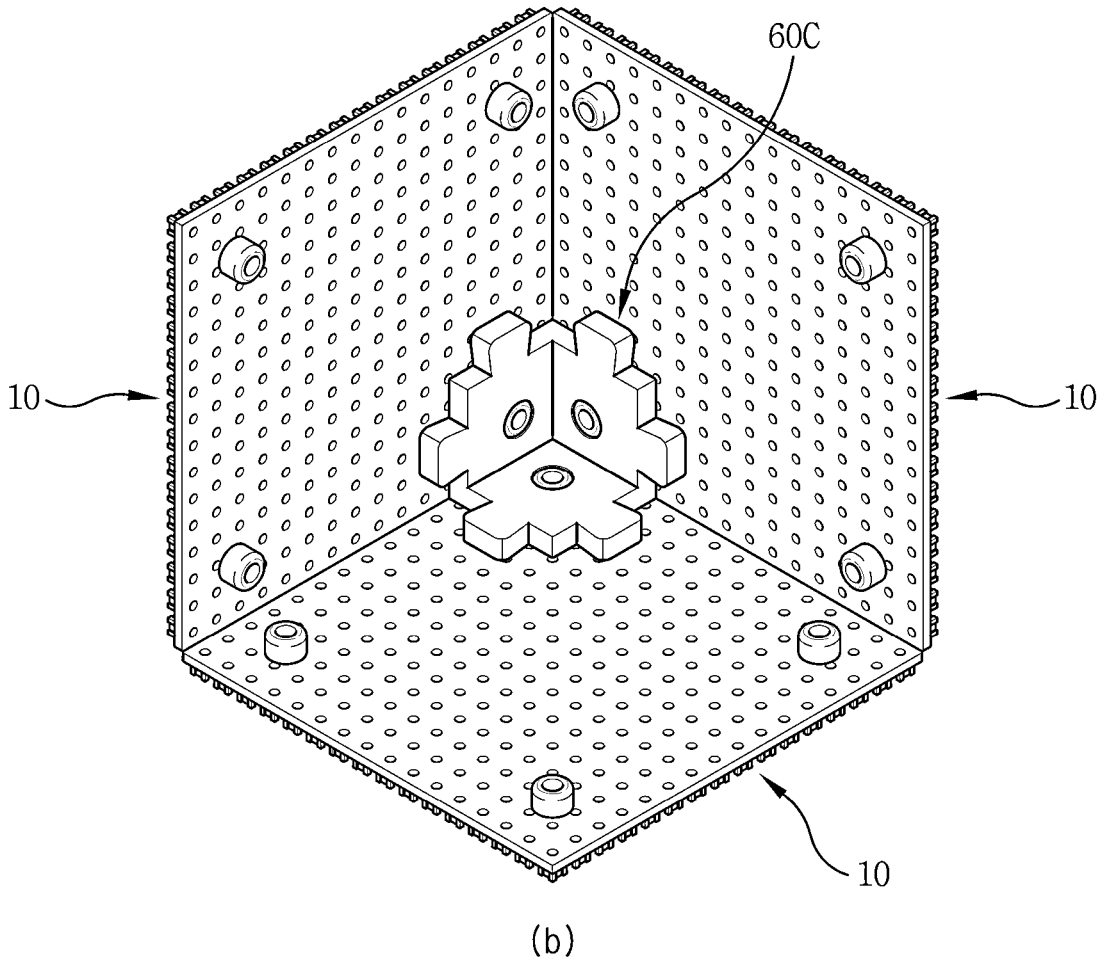

FIG. 8C illustrates a bent connection member 60C according to yet another embodiment of the present disclosure (see (a) and (b) of FIG. 8C). The bent connection member 60C according to this embodiment can connect three block frames 10 disposed at right angles to each other. That is, it is possible to connect the block frames 10 disposed in the x, y, and z directions, respectively. To this end, the bent connection member 60C according to this embodiment includes a third plate portion 64 in addition to the first and second plate portions 61 and 62 connected to each other at a right angle. The third plate portion 64 is connected at a right angle to each of the first and second plate portions 61 and 62. The frame coupling hole 63 is formed in the third plate portion 64 as well. One block frame 10 can be coupled to each of the first, second, and third plate portions 61, 62, and 64 of the bent connection member 60C.

Figure 9:
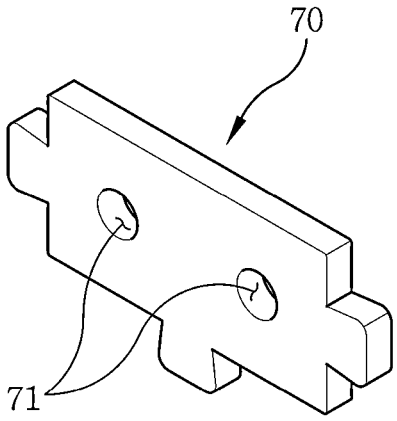
FIG. 9 shows various views illustrating a flat connection member used in a block-type art kit according to the present disclosure.
Figure 9:
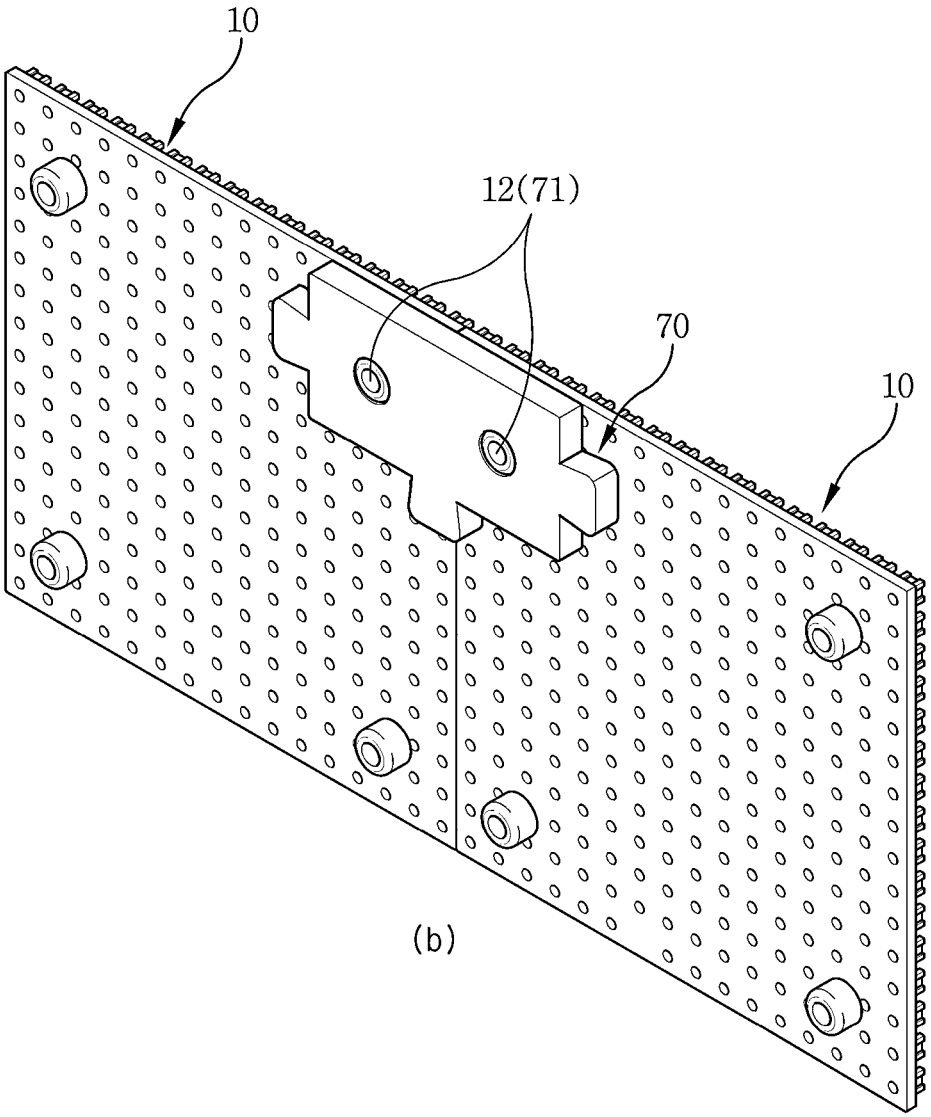

The block-type art kit 1 according to the present disclosure may further include a flat connection member 70. FIG. 9 illustrates a flat connection member 70 according to one embodiment of the present disclosure (see (a) and (b) of FIG. 9).

The flat connection member 70 has a long plate shape as a whole and has a plurality of second frame coupling holes 71 into which the frame coupling protrusions 12 can be inserted. For example, FIG. 9 shows a case where the flat connection member 70 has two second frame coupling holes 71.

The flat connection member 70 can connect two block frames 10 on the same plane. That is, one block frame 10 is coupled to one second frame coupling hole 71 of the flat connection member 70, and another block frame 10 is coupled to the other second frame coupling hole 71, so that the block frames 10 can be connected to each other on the same plane.

Figure 10:
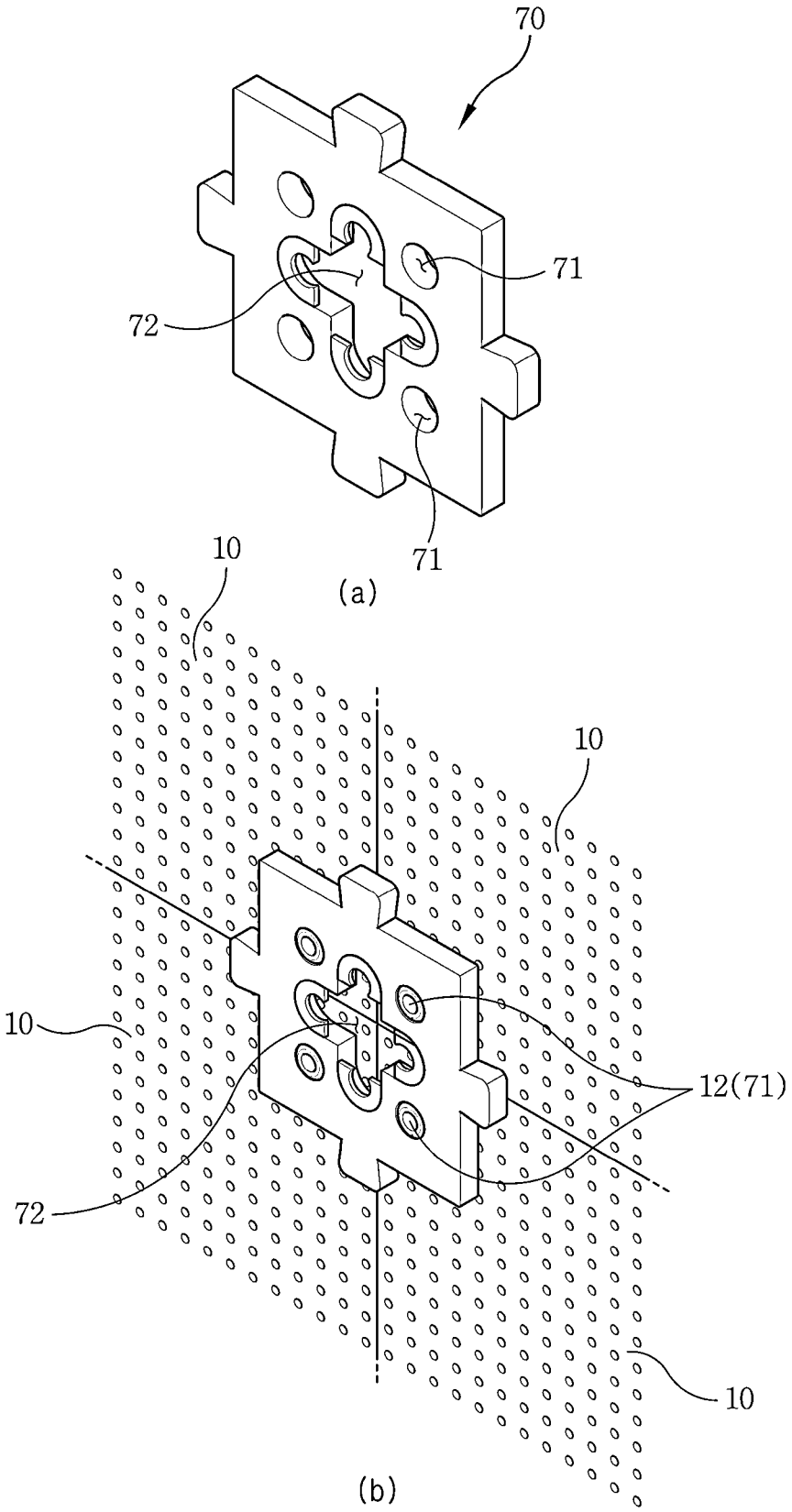
FIGS. 10 and 11 show various views illustrating another flat connection member used in a block-type art kit according to the present disclosure.

FIG. 10 illustrates a flat connection member 70 according to another embodiment of the present disclosure (see (a) and (b) of FIG. 10). As shown in FIG. 10, the flat connection member 70 has second frame coupling holes 71 at four portions and a frame fixing hole 72 at the center. This flat connection member 70 can connect four block frames 10 on the same plane by being coupled to the frame coupling protrusions 12 of different block frames 10 at four portions.

Figure 11:
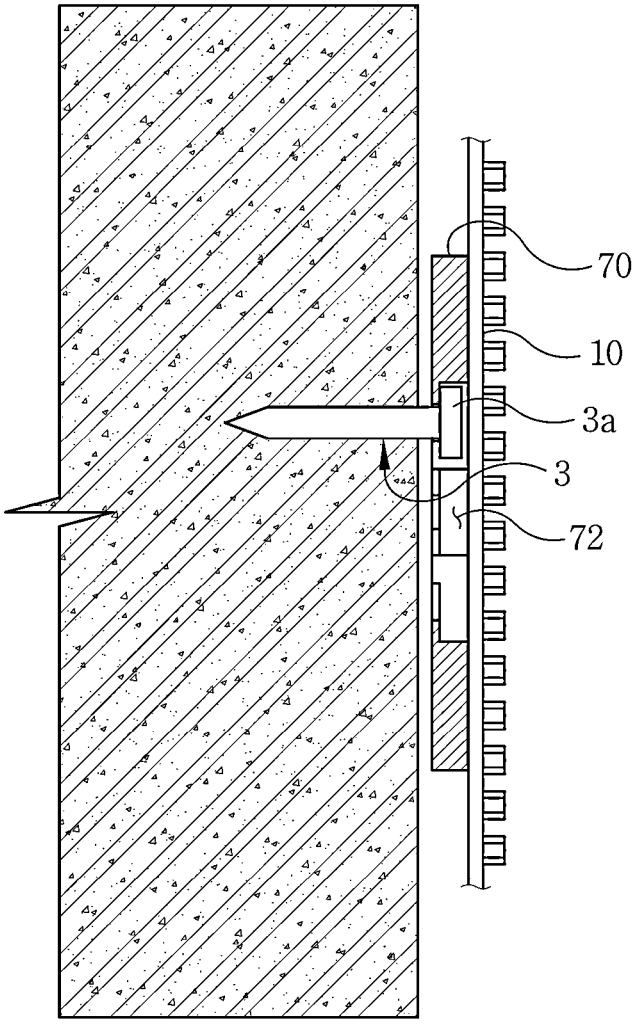

In the flat connection member 70 according to this embodiment, the frame fixing hole 72 is formed in a cross shape as a whole, and a fixing jaw is formed at each end of the cross shape. As shown in FIG. 11, a head 3*a* of a nail 3 can be engaged with the frame fixing hole 72, so that the block frame 10 can be fixed to a wall 4. That is, the head 3*a* of the nail 3 can be inserted into a central portion of the frame fixing hole 72 and then moved behind the fixing jaw, thereby being combined with the flat connection member 70.

Figure 12:
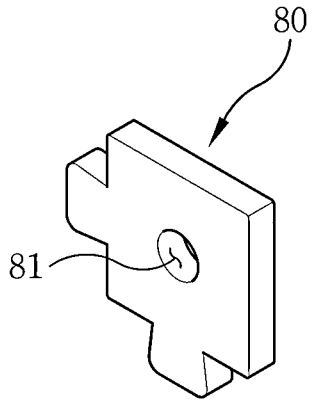
FIG. 12 shows various views illustrating a corner member used in a block-type art kit according to the present disclosure.
Figure 12:
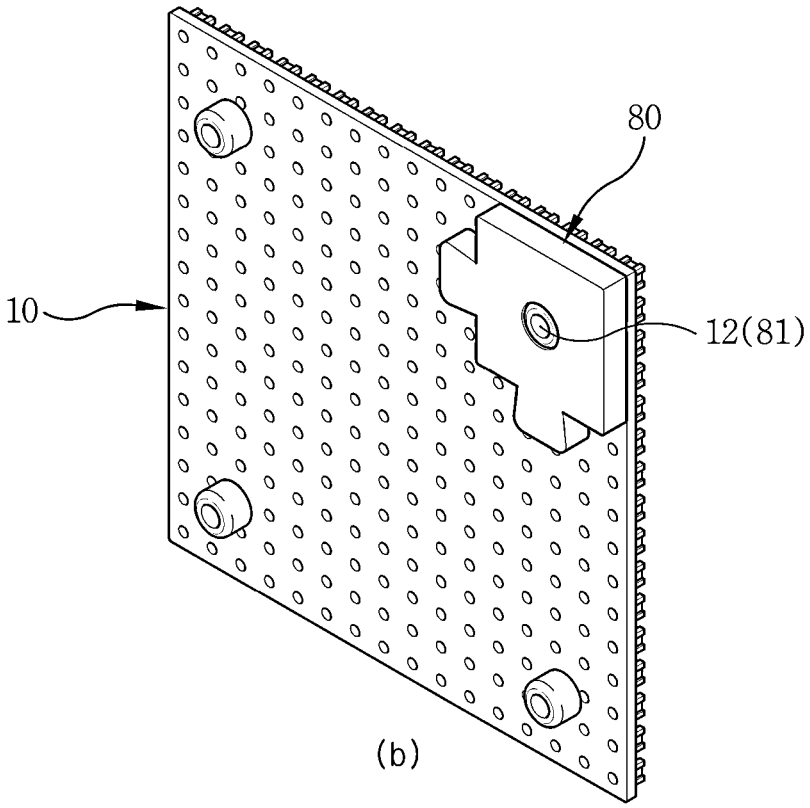

The block-type art kit 1 according to the present disclosure may further include a corner member 80. FIG. 12 illustrates a corner member 80 according to the present disclosure (see (a) and (b) of FIG. 12).

The corner member 80 has one third frame coupling hole 81 into which the frame coupling protrusion 12 of the block frame 10 can be inserted. The corner member 80 may have the same thickness as the flat connection member 70.

In the case where a plurality of block frames 10 are connected to each other by the flat connection members 70, the corner member 80 is fixed to each corner of an entire plate formed by the block frames 10. Therefore, the entire plate formed by the block frames 10 can have the same thickness along the circumference, and the entire plate can be stably fixed to the wall or the like.

Figure 13A:
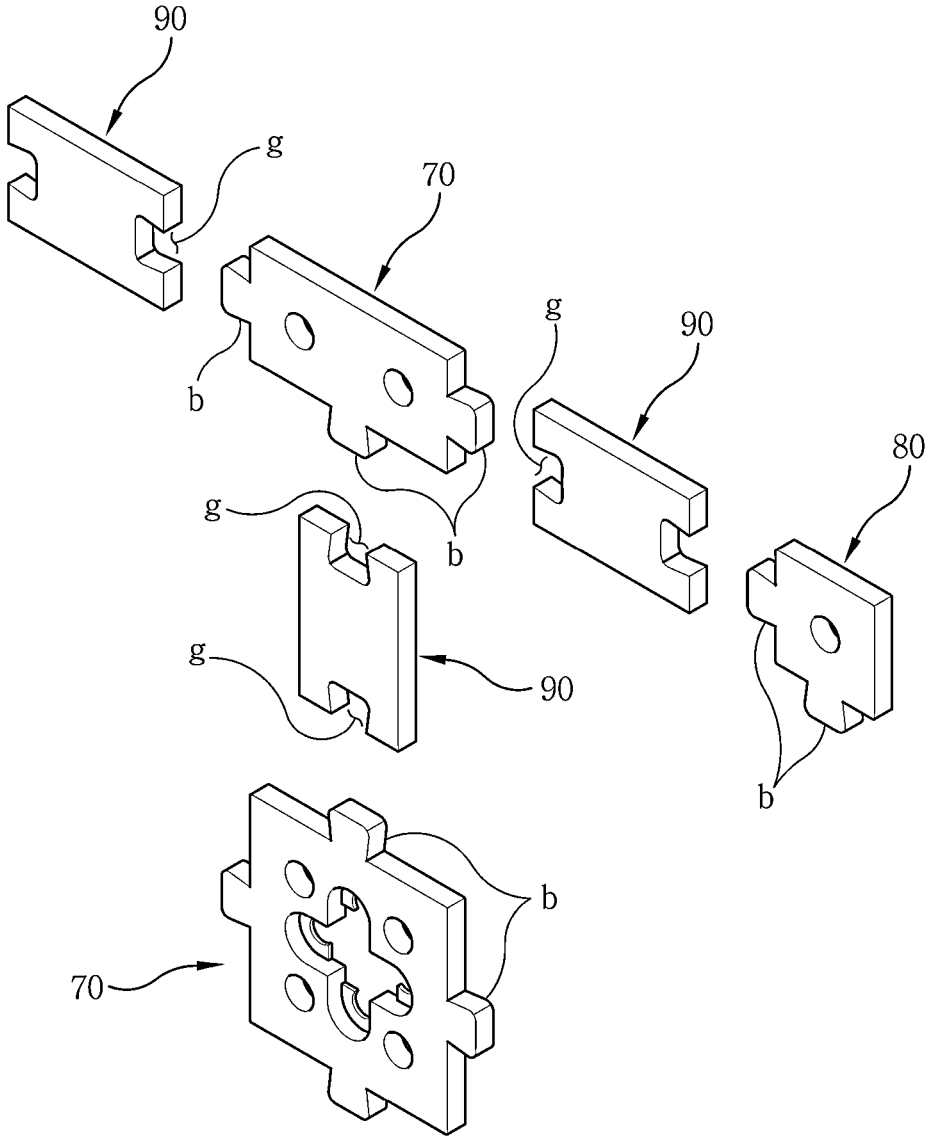
FIGS. 13A and 13B show various views illustrating an auxiliary connection member used in a block-type art kit according to the present disclosure.
Figure 13A:
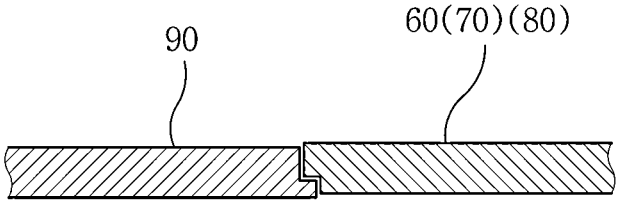

The block-type art kit 1 according to the present disclosure may further include an auxiliary connection member 90. FIG. 13A illustrates an auxiliary connection member 90 according to one embodiment of the present disclosure (see (a) and (b) of FIG. 13A).

In the case of connecting a plurality of block frames 10, the auxiliary connection member 90 is disposed between the flat connection members 70, between the bent connection member 60 and the flat connection member 70, or between the flat connection member 70 and the corner member 80, and is used to connect both members to each other. The auxiliary connection member 90 may have the same thickness as the flat connection member 70 and the like.

The auxiliary connection member 90 may have a female portion (g) (or a male portion (b)) formed at each of both ends thereof, and each member connected to the auxiliary connection member 90 may have a male portion (b) (or a female portion (g)) formed at each of some ends thereof. Therefore, the auxiliary connection member 90 and the members connected to the auxiliary connection member 90 may be firmly coupled to each other by the engagement of the female portion (g) and the male portion (b). As shown in (b) of FIG. 13A, the auxiliary connection member 90 and the members connected thereto may be formed to have corresponding steps to be engaged with each other in the thickness direction, thereby being more stably coupled without twisting each other in the thickness direction.

Figure 13B:
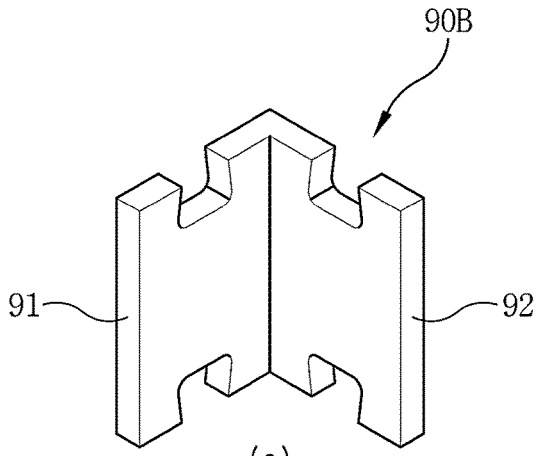
Figure 13B:
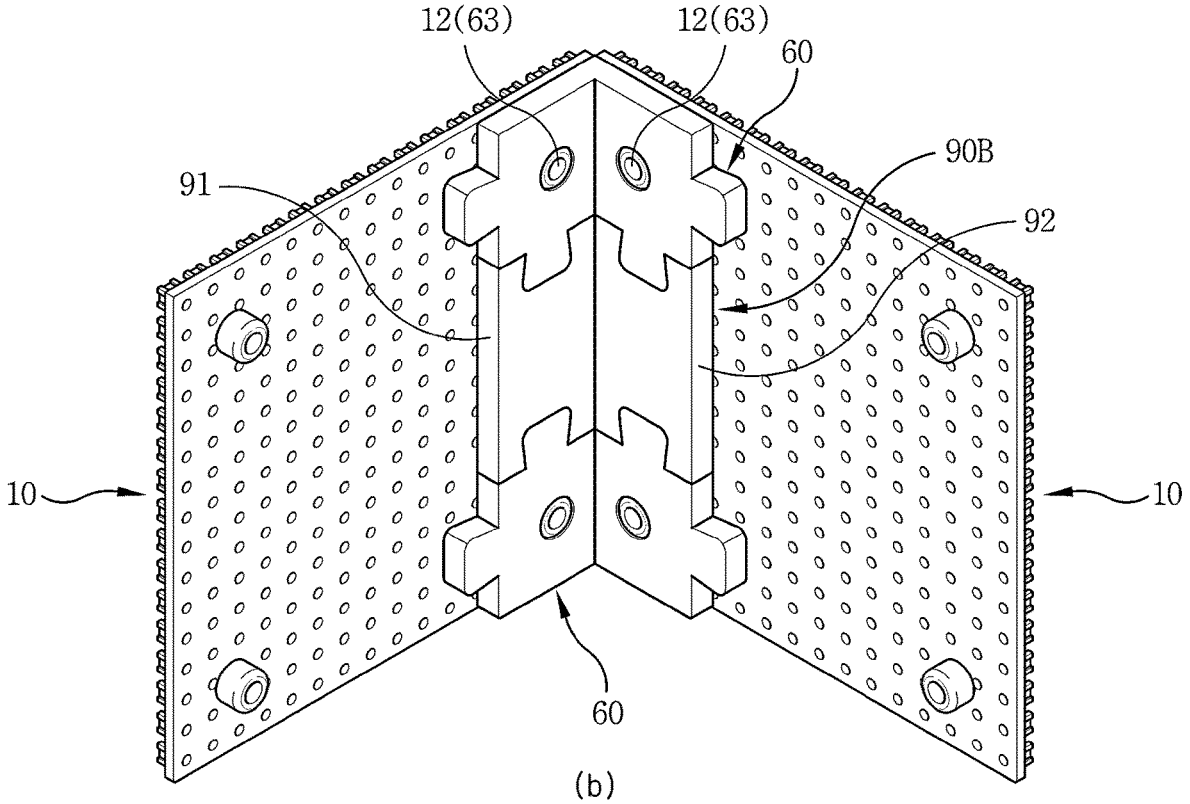

FIG. 13B illustrates an auxiliary connection member 90B according to another embodiment of the present disclosure (see (a) and (b) of FIG. 13B). The auxiliary connection member 90B according to this embodiment can be used in the case of connecting the block frames 10 at a right angle. The auxiliary connection member 90B according to this embodiment includes a first auxiliary plate 91 and a second auxiliary plate 92 connected to each other at a right angle. This auxiliary connection member 90B is combined at upper and lower portions thereof with the bent connection members 60, respectively.

Figure 14:
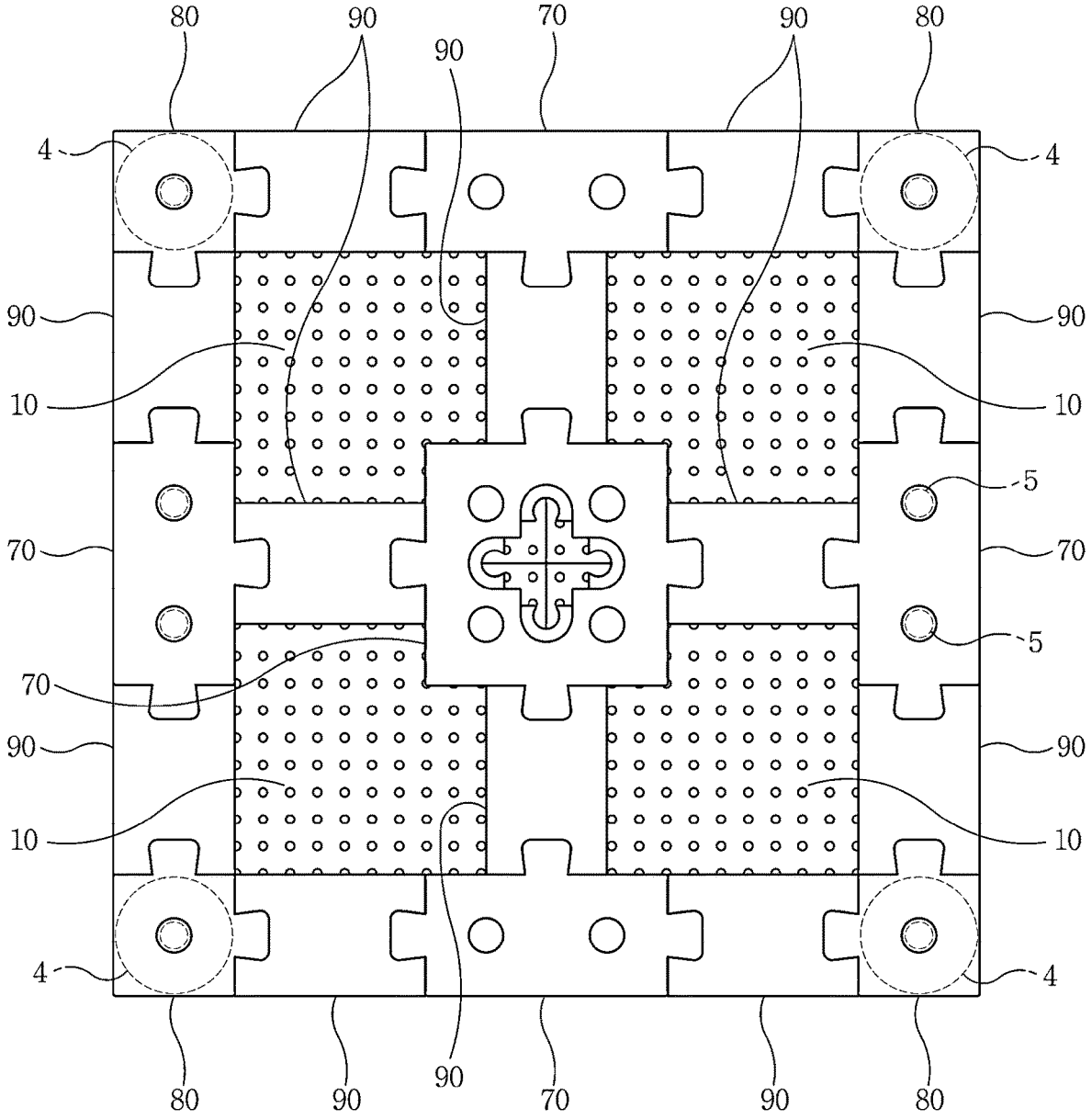
FIG. 14 is a view illustrating an exemplary connection of block frames using flat connection members and so on used in a block-type art kit according to the present disclosure.

FIG. 14 is a view illustrating an exemplary connection of block frames 10 using flat connection members 70 and so on according to the present disclosure. For example, FIG. 14 shows a state in which four block frames 10 are connected to each other. The flat connection member 70 having two second frame coupling holes 71 is disposed at a portion where the two block frames 10 come into contact with each other. The flat connection member 70 having four second frame coupling holes 71 is disposed at a portion where the four block frames 10 come into contact with each other. The corner members 80 are disposed at corners of the entire plate formed by all the block frames 10. Each auxiliary connection member 90 is disposed between the flat connection members 70 or between the flat connection member 70 and the corner member 80. In the case of combining the block frames 10 three-dimensionally, the bent connection member 60 may be used instead of the corner member 80.

In addition, a suction plate 6 or a magnet 5 may be fixed to the second frame coupling hole 71 of the flat connection member 70 or the third frame coupling hole 81 of the corner member 80. Accordingly, the block-type art kit 1 according to the present disclosure can be fixed to a smooth surface such as a glass surface or a refrigerator surface.

While the present disclosure has been particularly shown and described with reference to exemplary embodiments thereof, it will be understood by those skilled in the art that various changes in form and details may be made therein without departing from the scope of the present disclosure as defined by the appended claims.

What is claimed is:

1. A block-type art kit comprising:

a block frame including a substrate and a plurality of coupling protrusions arranged at regular intervals in row and column directions and protruding upwardly from on an upper surface of the substrate, each coupling protrusion having a through hole formed at a center thereof in a direction penetrating therethrough and penetrating through a portion of the substrate from which the corresponding coupling protrusion extends;

a plurality of color blocks each having a coupling recess provided on a lower surface thereof such that each of the coupling protrusions is inserted into a corresponding coupling recess, at least two of the plurality of color blocks having different colors, each of the plurality of color blocks comprising a solid and continuous upper surface that is at least partially aligned with the through hole of a corresponding coupling protrusion, each of the thorough holes configured to enable a selected one of the plurality of color blocks to be detached from a corresponding coupling protrusion; and an adapter block configured to connect the coupling protrusion and the color block, wherein the adapter block comprises an upper portion and a lower portion narrower than the upper portion, wherein the adapter block comprises a second through hole penetrating therethrough, and wherein, when the adapter block is connected to the coupling protrusion and the color block:

the second through hole is aligned with the through hole of a corresponding coupling protrusion, 1) A side surface of the upper portion of the adapter block is, or 2) both the side surface and a top surface of the upper portion of the adapter block are, in direct physical contact with an inner portion of a corresponding color block, a bottom surface of the upper portion of the adapter block is in direct physical contact with the corresponding coupling protrusion, the lower portion of the adapter block is in direct physical contact with and surrounded by the corresponding coupling protrusion, and the through hole of the corresponding coupling protrusion and the second through hole of the adapter block are together configured to enable the corresponding color block to be detached from the corresponding coupling protrusion.

2. The block-type art kit of claim 1, wherein the coupling protrusion has a rectangular shape on a horizontal cross-section and has an auxiliary coupling groove on each of four side surfaces.

3. The block-type art kit of claim 2, further comprising:

a plurality of quarter color blocks each formed to have a horizontal cross-section of a quarter of the size of the color block, each quarter color block having a second coupling recess at one lower corner portion thereof such that one corner portion of the coupling protrusion is inserted into the second coupling recess.

4. The block-type art kit of claim 1, wherein a block detachable hole is formed at a bottom of a side of the color block.

5. The block-type art kit of claim 1, wherein the adapter block has a horizontal cross-section of the same shape as that of the coupling protrusion and has a fixing protrusion formed on a lower surface thereof to be inserted into the through hole of the coupling protrusion.

6. The block-type art kit of claim 1, further comprising:

an auxiliary adapter block having a smaller height than the coupling protrusion, and having at a center thereof a coupling hole having a shape engaged with the coupling protrusion.

7. The block-type art kit of claim 1, further comprising:

a second adapter block for connecting the coupling protrusion and the adapter block.

8. The block-type art kit of claim 7, wherein the second adapter block is formed to surround the coupling protrusion at a lower portion thereof and have at an upper portion thereof the same horizontal cross-section as that of the coupling protrusion, and wherein the second adapter block has at a center thereof a second through hole vertically penetrating the second adapter block.

9. The block-type art kit of claim 1, further comprising:

a plurality of frame coupling protrusions formed on a lower surface of the block frame and arranged to be spaced apart in the row and column directions.

10. The block-type art kit of claim 9, further comprising:

a bent connection member composed of a first plate portion and a second plate portion connected to each other at a right angle, each of the first plate portion and the second plate portion having a frame coupling hole into which the frame coupling protrusion is inserted.

11. The block-type art kit of claim 9, further comprising:

a flat connection member having a plate shape and having a plurality of second frame coupling holes into which the frame coupling protrusions are inserted.

12. The block-type art kit of claim 11, further comprising:

a corner member having one third frame coupling hole into which the frame coupling protrusion is inserted.

13. The block-type art kit of claim 1, further comprising an auxiliary adapter block having a smaller height than the coupling protrusion, and having at a center thereof a coupling hole configured to receive the coupling protrusion, wherein the coupling hole is larger in diameter than the through hole of the corresponding coupling protrusion, and wherein, when the auxiliary adapter block is assembled between the color block and the coupling protrusion, the coupling hole of the auxiliary adapter block is aligned with both of the second through hole of the adapter block and the through hole of the corresponding coupling protrusion.

* * * * *